US007102297B2

(12) United States Patent
Trestman et al.

(10) Patent No.: US 7,102,297 B2
(45) Date of Patent: Sep. 5, 2006

(54) BALLAST WITH END-OF-LAMP-LIFE PROTECTION CIRCUIT

(75) Inventors: Grigoriy A. Trestman, Salem, MA (US); Joseph L. Parisella, Beverly, MA (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 11/096,008

(22) Filed: Mar. 31, 2005

(65) Prior Publication Data

US 2005/0269972 A1 Dec. 8, 2005

(51) Int. Cl.
*H05B 41/16* (2006.01)

(52) U.S. Cl. ..... 315/282; 315/274; 315/291; 315/312; 315/209 R

(58) Field of Classification Search ..... None
See application file for complete search history.

(56) References Cited

U.S. PATENT DOCUMENTS 5,930,126 A * 7/1999 Griffin et al. ..... 363/37
6,008,593 A * 12/1999 Ribarich ..... 315/307
6,292,339 B1 * 9/2001 Brooks ..... 361/78
6,696,798 B1 * 2/2004 Nishimoto et al. ..... 315/224

* cited by examiner

*Primary Examiner*—Tuyet Thi Vo
(74) *Attorney, Agent, or Firm*—Kenneth D. Labudda; Fitch, Even, Tabin & Flannery

(57) ABSTRACT

An electronic ballast (10) for powering a lamp load comprising an even number of gas discharge lamps (30,32, . . . ,34,36) includes an inverter (300), an output circuit (400), and a protection circuit (500). During operation, protection circuit (500) disables the inverter (300) in response to an end-of-lamp-life condition that is characterized by a predetermined imbalance in the operating current provided to each of the even number of lamps. Preferably, the output circuit (400) includes a current-sensing transformer (480) for detecting the predetermined imbalance, and the protection circuit (500) includes a silicon-controlled rectifier (530) for disabling the inverter (300).

17 Claims, 4 Drawing Sheets

BALLAST WITH END-OF-LAMP-LIFE PROTECTION CIRCUIT

FIELD OF THE INVENTION

The present invention relates to the general subject of circuits for powering discharge lamps. More particularly, the present invention relates to a ballast for powering an even number of lamps that includes a circuit for protecting the ballast and lighting fixture in the event of an end-of-lamp-life condition.

BACKGROUND OF THE INVENTION

When a fluorescent lamp approaches the end of its operating life, the electrode emission capability of at least one of its cathodes decreases, accompanied by a corresponding increase in the voltage drop across that cathode. The increased voltage drop caused increased power dissipation in that cathode and a potentially significant increase in the temperature of the lamp in the area of that cathode. The increase in temperature is especially pronounced in small diameter lamps (such as T5 lamps) because those lamps have a smaller surface area and a larger operating current in comparison with larger diameter lamps (such as T8 lamps).

The localized high temperatures that often occur in small diameter lamps during end-of-life conditions present a potentially serious safety hazard. Accordingly, ballasts for powering small diameter lamps require some form of protection circuitry for detecting and responding to end-of-lamp-life conditions. Although the prior art is replete with approaches for protecting ballasts under various lamp fault conditions, a continued need exists for economical circuits for protecting against hazards that accompany end-of-lamp-life conditions.

DETAILED DESCRIPTION OF THE PREFERRED EMBODIMENTS

Figure 1:
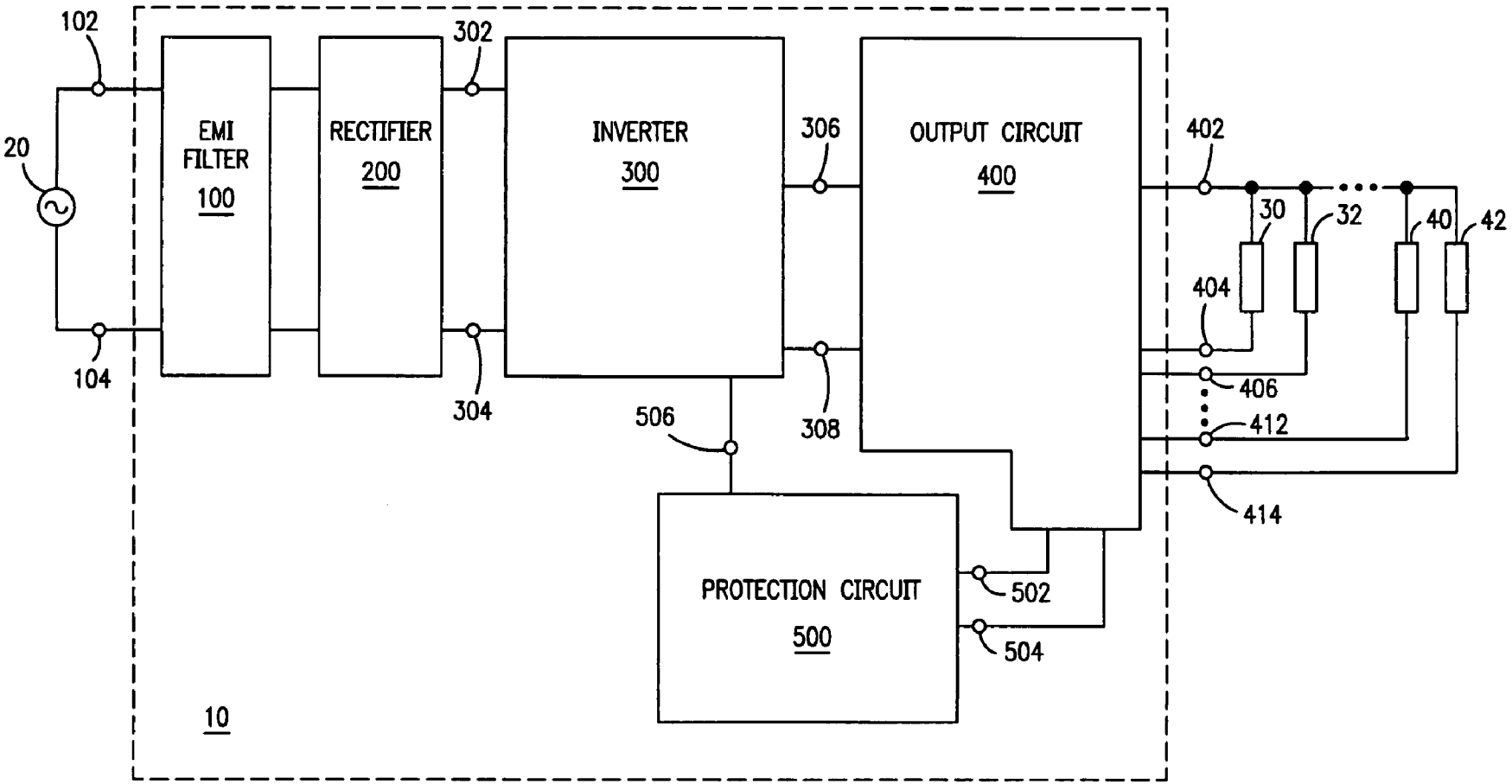
FIG. 1 is a block diagram schematic of a ballast with an end-of-lamp-life protection circuit, in accordance with a first preferred embodiment of the present invention.

FIG. 1 describes an electronic ballast 10 for powering a lamp load that includes an even number (2N) of gas discharge lamps 30,32, . . . ,40,42. Ballast 10 comprises an electromagnetic interference (EMI) filter 100, a rectifier circuit 200, an inverter 300, an output circuit 400, and a protection circuit 500.

EMI filter 100 comprises input terminals 102,104 that are adapted to receive a conventional source of alternating current (AC) voltage, such as 120 volts (rms) at 60 hertz. Rectifier circuit 200 is coupled to EMI filter 100, and provides a substantially direct current (DC) voltage to inverter 200. EMI filter 100 and rectifier circuit 200 may be realized by any of a number of suitable arrangements that are well known to those skilled in the art. For example, rectifier circuit 200 may be realized by a combination of a full-wave diode bridge and a boost converter.

Inverter 300 comprises input terminals 302,304 and output terminals 306,308. During operation, inverter 300 receives the substantially DC voltage at input terminals 302,304 and provides a high frequency (e.g., 20,000 hertz or greater) alternating voltage at output terminals 306,308. Output circuit 400 is coupled to output terminals 306,308 of inverter 300. During operation, output circuit 400 provided an operating current to each of the even number of gas discharge lamps 30,32, . . . ,40,42.

Protection circuit 500 is coupled to inverter 300 and output circuit 400. During operation, protection circuit 500 disables inverter 300 in response to an end-of-lamp-life condition that is characterized by a predetermined imbalance in the operating current provided to each of the even number of gas discharge lamps 30,32, . . . ,40,42.

In a first preferred embodiment of the present invention, in response to an end-of-lamp-life condition, protection circuit 500 disables inverter 300 for a predetermined shutdown period (e.g., one second or more), and then allows inverter 300 to resume operation for at least a limited time upon completion of the predetermined shutdown period. As will be described in further detail herein, protection circuit 500 thus accommodates replacement of a failed/failing lamp (hereinafter referred to as an "end-of-life lamp") without requiring cycling of the input power to ballast 10.

Figure 2:
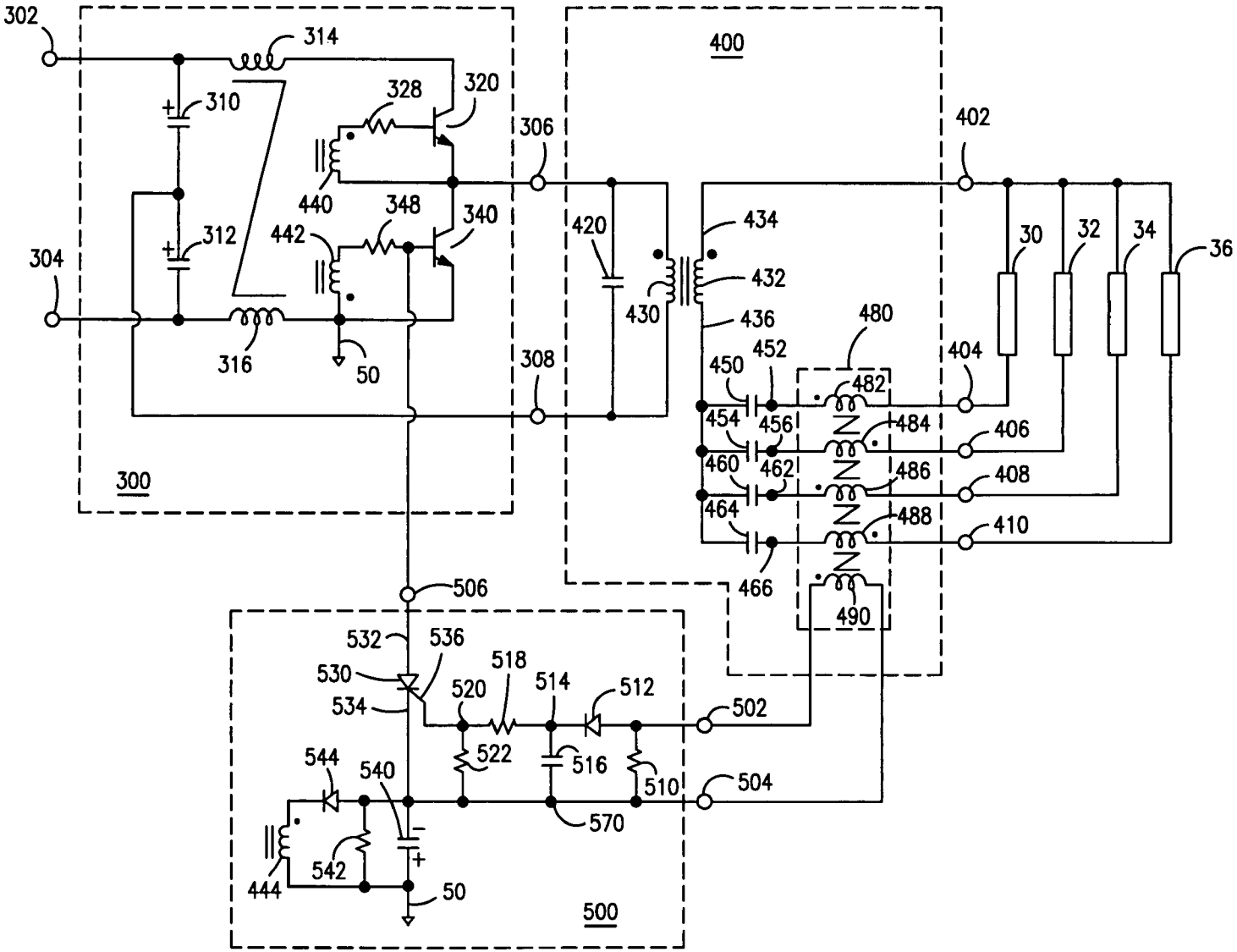
FIG. 2 is a detailed electrical schematic of a portion of a ballast with an end-of-lamp-life protection circuit, in accordance with a first preferred embodiment of the present invention.

Referring now to FIG. 2, in a first preferred embodiment of the present invention, the lamp load comprises first, second, third, and fourth gas discharge lamps 30,32,34,36. Inverter 300 is implemented as a self-oscillating current-fed half-bridge inverter comprising first and second input terminals 302,304, first and second output terminals 306,308, bulk capacitors 310,312, current-feed inductors 314,316, a first inverter transistor 320, a first base drive circuit 328,440, a second inverter transistor 340, and a second base drive circuit 348,442. First inverter transistor 320 is operably coupled between first input terminal 302 and first output terminal 306. Second inverter transistor 340 is operably coupled between first output terminal 306 and second output terminal 308. Base drive windings 440,442 are magnetically coupled to an output transformer 430,432 within output circuit 400.

As described in FIG. 2, output circuit 400 is preferably implemented as an isolated parallel resonant output circuit that includes first, second, third, fourth, and fifth output connections 402,404,406,408,410, a resonant capacitor 420, an output transformer having a primary winding 430 and a secondary winding 432, a first ballasting capacitor 450, a second ballasting capacitor 454, a third ballasting capacitor 460, a fourth ballasting capacitor 464, and a current-sensing transformer 480. First output connection 402 is coupled to the first and second lamps 30,32. Second output connection 404 is coupled to first lamp 30. Third output connection 406 is coupled to second lamp 32. Fourth output connection 408 is coupled to third lamp 34. Fifth output connection 410 is coupled to fourth lamp 36. Resonant capacitor 420 and primary winding 430 are each coupled between first and second output terminals 306,308 of inverter 300. Secondary winding 430 has an upper end 434 and a lower end 436, wherein upper end 434 is coupled to first output connection 402. First ballasting capacitor 450 is coupled between a first node 452 and lower end 436 of secondary winding 432. Second ballasting capacitor 454 is coupled between a second node 456 and lower end 436 of secondary winding 432. Current-sensing transformer 480 includes first, second, third, and fourth windings 482,484,486,488 and a detection winding 490. First winding 482 is electrically coupled between second output connection 404 and first node 452. Second winding 484 is magnetically coupled to first winding 482 and is electrically coupled between third output connection 406 and second node 456. Third winding 486 is magnetically coupled to first and second windings 482,484 and is electrically coupled between fourth output connection 408 and a third node 462. Fourth winding 488 is magnetically coupled to first, second, and third windings 482,484, 486 and is electrically coupled between fifth output connection 410 and a fourth node 466.

During operation of ballast 10, the operating current of first lamp 30 flows through first winding 482, the operating current of second lamp 32 flows through second winding 484, the operating current of third lamp 34 flows through third winding 486, and the operating current of fourth lamp 36 flows through fourth winding 488. Detection winding 490 is magnetically coupled to first, second, third, and fourth windings 482,484,486,488 and is electrically coupled to protection circuit 500.

Within current-sensing transformer 480, windings 482, 484,486,488 and detection winding 490 are preferably configured with polarities as indicated by the dots in FIG. 2. More specifically, first winding 482 and second winding 484 have opposing polarities; similarly, third winding 486 and fourth winding 488 have opposing polarities.

During operation, current-sensing transformer 480 provides a predetermined voltage (e.g., 10 volts peak) across detection winding 490 in response to a predetermined imbalance in the operating currents of first and second lamps 30,32 and third and fourth lamps 34,36. The predetermined voltage is received by protection circuit 500 (via input terminals 502,504). In response to the predetermined voltage, protection circuit 500 disables inverter 300. Conversely, when the operating currents of lamps 30,32 and lamps 34,36 are substantially equal (such as what occurs during operation, when none of the lamps 30,32,34,36 is at or near an end-of-life condition), the voltage across detection winding 490 will be substantially zero; correspondingly, protection circuit 500 will not disable inverter 300.

Current-sensing transformer 480 may be realized as a toroid wherein first, second, third, and fourth windings 484,484,486,488 are simply wires that pass through the core with opposing polarities, as previously described, and detection winding 490 has an appropriate number of turns (e.g., 100 turns) so that a suitable low level alternating voltage (e.g., with a peak value on the order of 10 volts or so) is provided to protection circuit 500 (via input terminals 502, 504) in response to an end-of-lamp-life condition.

As described in FIG. 2, in a first preferred embodiment of the present invention, protection circuit 500 disables inverter 300 for a predetermined shutdown period in response to an end-of-lamp-life condition. Upon completion of the predetermined shutdown period, protection circuit 500 allows inverter 300 to resume operation for at least a limited time, the duration of which is dependent upon whether or not an end-of-lamp-life condition is still present.

Referring again to FIG. 2, in a first preferred embodiment of the present invention, protection circuit 500 comprises first and second input terminals 502,504, an output terminal 506, a first resistor 510, a diode 512, a first capacitor 516, a second resistor 518, a third resistor 522, an electronic switch 530, a second capacitor 540, a fourth resistor 542, a second diode 544, and an auxiliary winding 444 that is magnetically coupled to the output transformer 430,432. First and second input terminals 502,504 are coupled to detection winding 490 of current-sensing transformer 480. Output terminal 506 is coupled to a base of second inverter transistor 340. First resistor 510 is coupled between first and second input terminals 502,504. Diode 512 is coupled between first input terminal 502 and a fifth node 514. First capacitor 516 is coupled between fifth node 514 and second input terminal 504 (also referred to as node 570 in FIG. 2). Second resistor 518 is coupled between fifth node 514 and sixth node 520. Third resistor 522 is coupled between sixth node 520 and second input terminal 504. Electronic switch 530 is coupled between output terminal 506 and second input terminal 504. Electronic switch 530 includes a control lead 536 coupled to sixth node 520. Preferably, electronic switch 530 is realized by a silicon-controlled rectifier having an anode 532 coupled to the output terminal 506, a cathode 534 coupled to second input terminal 504, and a gate lead 536 coupled to sixth node 520. Second capacitor 540 is coupled between second input terminal 504 and circuit ground 50. Fourth resistor 542 is coupled between second input terminal 504 and circuit ground 50. Second diode 544 is coupled in series with auxiliary winding 444. The series combination of second diode 544 and auxiliary winding 444 is coupled between between second input terminal 504 and circuit ground 50.

The detailed operation of ballast 10 and protection circuit 500 is now explained with reference to FIG. 2 as follows.

During normal operation of ballast 10, when each of lamps 30,32,34,36 is in good condition and operating in a substantially normal manner, the currents that flow through windings 484,484,486,488 will be substantially equal. Consequently, the magnetic flux induced by the current flowing through first winding 482 will be substantially canceled out by the opposing magnetic flux induced by the current flowing through second winding 484, and the magnetic flux induced by the current flowing through third winding 486 will be substantially canceled out by the opposing magnetic flux induced by the current flowing through fourth winding 488. As a result, the net resulting magnetic flux in the core of current-sensing transformer 480 will be approximately zero, and the voltage/current induced in detection winding 490 will, correspondingly, be approximately zero. With approximately zero voltage/current at input terminals 502, 504, the voltage between gate 536 and cathode 534 of silicon-controlled rectifier 530 will be at or near zero, so silicon-controlled rectifier 530 will remain off. With silicon-controlled rectifier 530 off, inverter 300 will be allowed to continue to operate in normal manner.

During that time, with inverter 300 operating in a normal manner, the voltage across auxiliary winding 444 will be a low level alternating voltage (e.g., with a peak value of 6 volts or so) that is used to provide a negative bias (e.g., 5 volts or so, with a polarity as indicated in FIG. 2) across capacitor 540. More particularly, during the negative half cycles of the alternating voltage across auxiliary winding 444, diode 544 will be forward-biased, thereby allowing capacitor 540 to charge up; during the zero-valued half cycles of the alternating voltage across auxiliary winding 444, diode 544 will be reverse-biased, during which time no charging current will be provided to capacitor 540. The negative bias voltage across capacitor 540 is provided in order to ensure proper disabling of inverter 300 in response to an end-of-lamp-life condition.

When one of the lamps 30,32,34,36 approaches the end of its operating life, the current through that lamp will decrease (in comparison with its normal operating level). Under that condition, the magnetic flux cancellation effect (previously described) will no longer occur. Rather, the reduced current in the end-of-life lamp will cause an imbalance by which the net resulting magnetic flux in the core of current-sensing transformer 480 will no longer be approximately zero; correspondingly, the voltage/current induced in detection winding 490 will likewise no longer be approximately zero. Once the current through the end-of-life lamp decreases sufficiently, the voltage/current induced in detection winding 490 will reach a level that is sufficient to cause silicon-controlled rectifier 530 to turn on and disable inverter 300. More specifically, within protection circuit 500, the voltage/current of detection winding 490 is peak-detected by diode 512 and capacitor 516. A scaled-down version of the voltage across capacitor 516 is applied (via a resistor divider comprising resistors 518,522) between the gate 536 and cathode 534 of silicon-controlled rectifier 530. Silicon-controlled rectifier 530 will turn on when the gate-to-cathode voltage reaches a trigger level of about 1 volt. When silicon-controlled rectifier 530 turns on, output terminal 506 is coupled to the negative bias voltage (e.g., 5 volts) across capacitor 540. With the negative bias voltage applied to the base of inverter transistor 340, transistor 340 will turn off and remain off (thereby disabling inverter 300) as long as a negative voltage is provided at output terminal 506 of protection circuit 500.

Once silicon-controlled rectifier 530 turns on and disables inverter 300 (in the manner previously described), the voltage across auxiliary winding 444 (which is derived from output transformer 430,432) will be approximately zero. With no source of energy to provide charging current, the negative bias voltage across capacitor 540 will begin to decay as capacitor 540 slowly discharges through resistor 542. At the same time, capacitor 516 discharges through resistors 518,522. After a certain period (e.g., 1 second or so), the voltage across capacitor 516 will drop to a level at which the gate-to-source voltage becomes insufficient (e.g., less than 1 volt or so) to keep silicon-controlled rectifier 530 turned on, at which point silicon-controlled rectifier 530 turns off.

With silicon-controlled rectifier 530 turned off, inverter 300 is allowed to restart. Once inverter 300 restarts, if an end-of-lamp-life condition still exists, then the previously described events will be repeated (i.e., protection circuit 500 will disable inverter 300 and keep inverter 300 disabled for a predetermined period, such as 1 second, before again allowing inverter 300 to restart); stated another way, inverter 300 will operate in what is commonly referred to as a "hiccupping" mode. If, on the other hand, the end-of-lamp-life condition no longer exists (e.g., due to relamping, wherein the end-of-life lamp has been replaced with a good lamp), then inverter 300 will be allowed to restart and power the lamps in a normal manner.

In this way, ballast 10 and protection circuit 500 respond to an end-of-lamp-life condition by disabling inverter 300 for a predetermined period, and then allowing inverter 300 to restart on a periodic basis. Advantageously, ballast 10 accommodates relamping without requiring that the power to the ballast be cycled (i.e., turned off and then on again) in order to resume normal operation upon replacement of an end-of-life lamp. Thus, ballast 10 is well-suited for those applications (e.g., in commercial buildings, wherein a large number of lighting fixtures may be powered from the same AC branch circuit) in which cycling of the power to the ballast following relamping is inconvenient or impractical.

Figure 3:
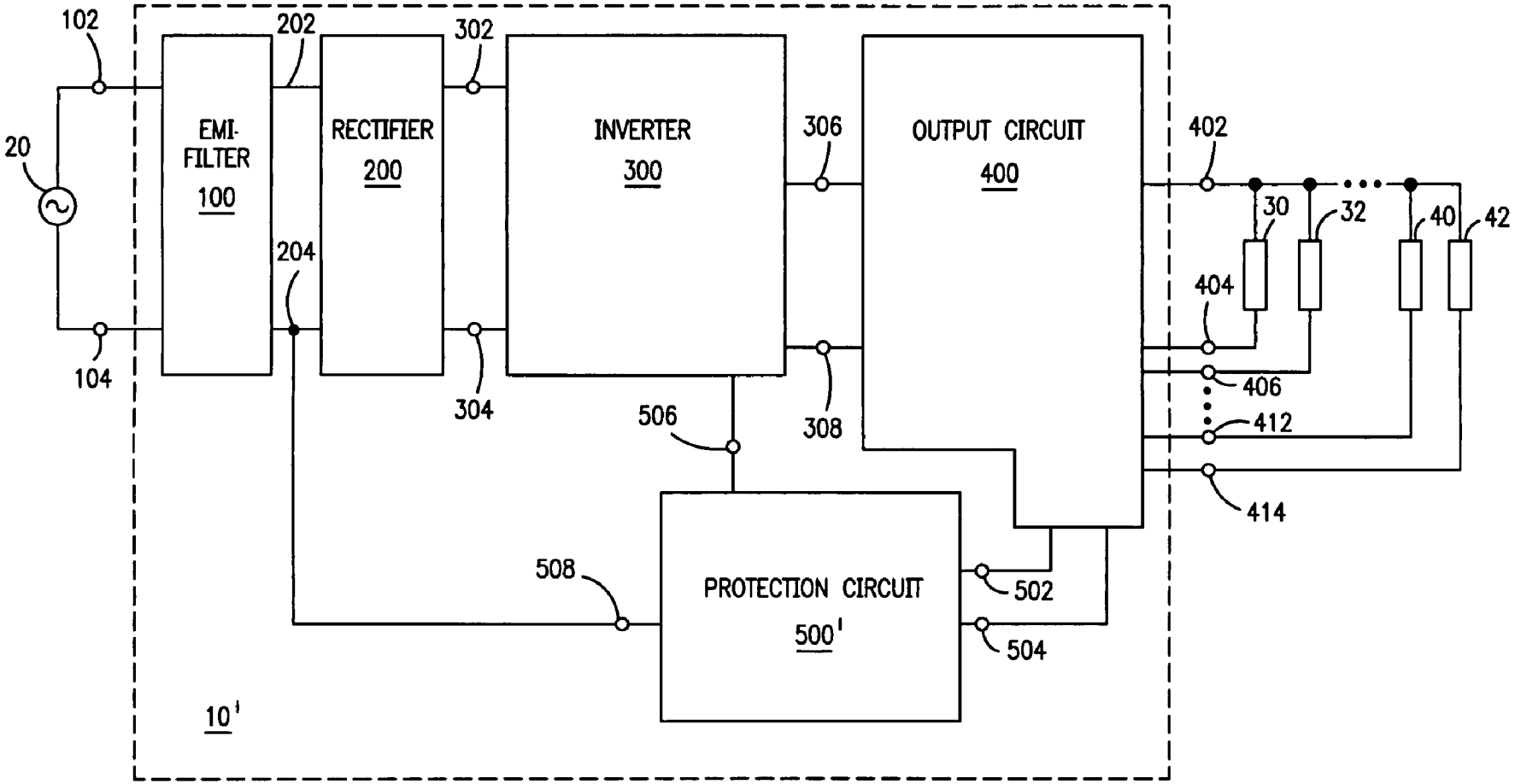
FIG. 3 is a block diagram schematic of a ballast with an end-of-lamp-life protection circuit, in accordance with a second preferred embodiment of the present invention.
Figure 4:
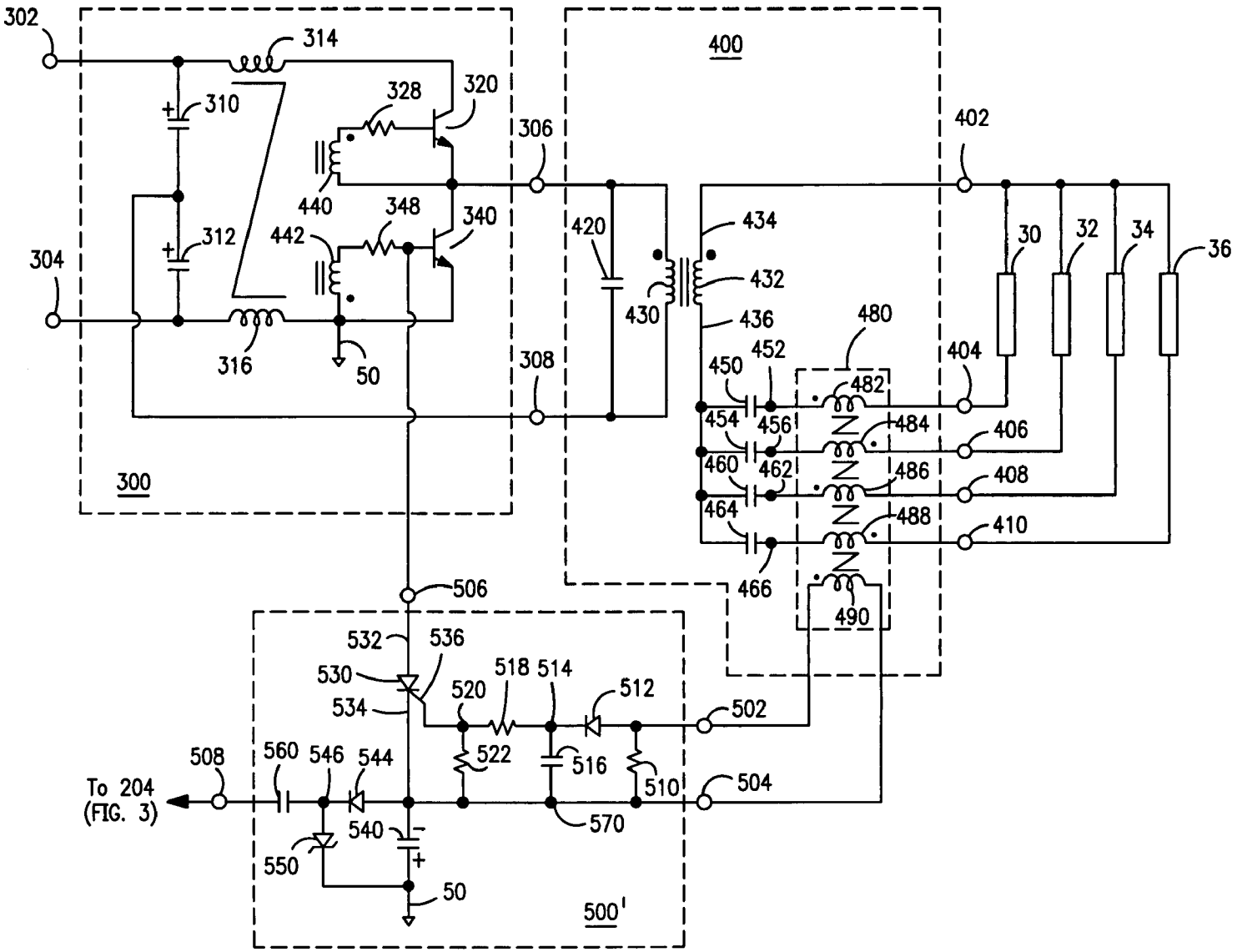
FIG. 4 is a detailed electrical schematic of a portion of a ballast with an end-of-lamp-life protection circuit, in accordance with a second preferred embodiment of the present invention.

Turning now to FIGS. 3 and 4, a second preferred embodiment of the present invention is shown and described. In the second preferred embodiment, ballast 10' includes a modified protection circuit 500' that is suited for those applications (e.g., residential lighting installations) in which it is preferred that the power to the ballast (e.g., from AC source 20) must be cycled in order to resume normal operation following relamping. In ballast 10', the preferred structures for realizing inverter 300 and output circuit 400 are the same as previously described in connection with the first preferred embodiment (as described in FIGS. 1 and 2).

Referring to FIG. 4, protection circuit 500' comprises first, second, and third input terminals 502,504,508, an output terminal 506, a first resistor 510, a first diode 512, a first capacitor 516, a second resistor 518, a third resistor 522, an electronic switch 530, a second capacitor 540, a second diode 544, a zener diode 550, and a third capacitor 560. First and second input terminals 502,504 are coupled to detection winding 490 of current-sensing transformer 480. Third input terminal 508 is coupled to a junction 204 (see FIG. 3) of EMI filter 100 and rectifier 200. Output terminal 506 is coupled to a base of second inverter transistor 340. First resistor 510 is coupled between first and second input terminals 502,504. Diode 512 is coupled between first input terminal 502 and a fifth node 514. First capacitor 516 is coupled between fifth node 514 and second input terminal 504 (also referred to as node 570 in FIG. 2). Second resistor 518 is coupled between fifth node 514 and sixth node 520. Third resistor 522 is coupled between sixth node 520 and second input terminal 504. Electronic switch 530 is coupled between output terminal 506 and second input terminal 504. Electronic switch 530 includes a control lead 536 coupled to sixth node 520. Preferably, electronic switch 530 is realized by a silicon-controlled rectifier having an anode 532 coupled to the output terminal 506, a cathode 534 coupled to second input terminal 504, and a gate lead 536 coupled to sixth node 520. Second capacitor 540 is coupled between second input terminal 504 and circuit ground 50. Fourth resistor 542 is coupled between second input terminal 504 and circuit ground 50. Second diode 544 is coupled between second input terminal 504 and a seventh node 546. Zener diode 550 is coupled between seventh node 546 and circuit ground 50. Finally, third capacitor 560 is coupled between seventh node 546 and third input terminal 508.

The detailed operation of ballast 10' and protection circuit 500' is now explained with reference to FIG. 4 as follows.

During normal operation of ballast 10', when each of lamps 30,32,34,36 is in good condition and operating in a substantially normal manner, the currents that flow through windings 484,484,486,488 will be substantially equal. Consequently, the magnetic flux induced by the current flowing through first winding 482 will be substantially canceled out by the opposing magnetic flux induced by the current flowing through second winding 484, and the magnetic flux induced by the current flowing through third winding 486 will be substantially canceled out by the opposing magnetic flux induced by the current flowing through fourth winding 488. As a result, the net resulting magnetic flux in the core of current-sensing transformer 480 will be approximately zero, and the voltage/current induced in detection winding 490 will, correspondingly, be approximately zero. With approximately zero voltage/current at input terminals 502, 504, the voltage between gate 536 and cathode 534 of silicon-controlled rectifier 530 will be at or near zero, so silicon-controlled rectifier 530 will remain off. With silicon-controlled rectifier 530 off, inverter 300 will be allowed to continue to operate in normal manner.

A source of half-wave rectified AC voltage is provided to protection circuit 500' via third input terminal 508. That voltage is used to provide a negative bias voltage (e.g., 5 volts or so, with a polarity as indicated in FIG. 4) across capacitor 540, which is charged up via diode 544 and capacitor 560. The negative bias voltage across capacitor 540 is provided in order to ensure proper disabling of inverter 300 in response to an end-of-lamp-life condition. Zener diode 550 is present in order to protect capacitor 540 from overvoltage that might otherwise occur due to line disturbances or other conditions that may affect the voltage derived from AC source 20 (see FIG. 3).

When one of the lamps 30,32,34,36 approaches the end of its operating life, the current that flows through that lamp will tend to decrease (in comparison with its normal operating level). Under that condition, the magnetic flux cancellation effect (previously described) will no longer occur. Rather, the reduced current in the end-of-life lamp will cause an imbalance by which the net resulting magnetic flux in the core of current-sensing transformer 480 will no longer be approximately zero; correspondingly, the voltage/current induced in detection winding 490 will likewise no longer be approximately zero. Once the current through the end-of-life lamp decreases sufficiently, the voltage/current induced in detection winding 490 will reach a level that is sufficient to cause silicon-controlled rectifier 530 to turn on and disable inverter 300. More specifically, within protection circuit 500', the voltage/current of detection winding 490 is peak detected by diode 512 and capacitor 516. A scaled-down version of the voltage across capacitor 516 is applied (via a resistor divider comprising resistors 518,522) between the gate 536 and cathode 534 of silicon-controlled rectifier 530. Silicon-controlled rectifier 530 will turn on when the gate-to-cathode voltage reaches a trigger level of about 1 volt. When silicon-controlled rectifier 530 turns on, output terminal 506 is coupled to the negative bias voltage (e.g., 5 volts) that is present across capacitor 540. With the negative bias voltage applied to the base of inverter transistor 340, transistor 340 will turn off and remain off as long as silicon-controlled rectifier 530 remains on and a negative voltage is provided at output terminal 506 of protection circuit 500'. Thus, inverter 300 will be disabled.

Once silicon-controlled rectifier 530 turns on and disables inverter 300 (in the manner previously described), the negative bias voltage across capacitor 540 will be maintained for as long as AC power continues to be applied to ballast 10'. Upon relamping (i.e., replacing the end-of-life lamp with a good lamp), the AC power to ballast 10' must be cycled in order to allow inverter 300 to restart and operate in a normal manner.

In this way, ballast 10' and protection circuit 500' respond to an end-of-lamp-life condition by disabling inverter 300 until the end-of-lamp-life condition is cured and the power to ballast 10' is cycled.

Although the present invention has been described with reference to certain preferred embodiments, numerous modifications and variations can be made by those skilled in the art without departing from the novel spirit and scope of this invention. For example, although the two specific preferred embodiments illustrated and described herein involve ballasts 10,10' that provide power to four lamps 30,32,34,36, the principles of the present invention are as readily applied (with no significant modifications to the detailed circuitry, apart from an adjustment in the number of windings in current-sensing transformer) to ballasts that power any even number of lamps, such as two lamps, four lamps, six lamps, etc.

What is claimed is:

1. A ballast for powering a lamp load comprising an even number of gas discharge lamps, the ballast comprising:

an inverter having input terminals and output terminals, the inverter being operable to receive a substantially direct current (DC) voltage at the input terminals and to provide a high frequency alternating voltage at the output terminals;

an output circuit coupled to the output terminals of the inverter, the output circuit having a plurality of output connections adapted for coupling to the lamp load, the output circuit being operable to provide an operating current to each of the even number of gas discharge lamps;

a protection circuit coupled to the inverter and the output circuit, the protection circuit being operable to disable the inverter in response to an end-of-lamp-life condition, wherein the end-of-lamp-life condition is characterized by a predetermined imbalance in the operating current provided to each of the even number of gas discharge lamps; and wherein:

the lamp load comprises first and second gas discharge lamps;

the inverter further comprises:

first and second input terminals;

first and second output terminals;

a first inverter transistor operably coupled between the first input terminal and the first output terminal; and a second inverter transistor operably coupled between the first output terminal and the second input terminal;

the output circuit further comprises:

first, second, and third output connections, wherein:

the first output connection is coupled to the first and second gas discharge lamps;

the second output connection is coupled to the first gas discharge lamp; and the third output connection is coupled to the second gas discharge lamp;

a resonant capacitor coupled between the first and second output terminals of the inverter;

an output transformer comprising a primary winding and a secondary winding, wherein:

the primary winding is coupled between the first and second output terminals of the inverter; and the secondary winding has an upper end and a lower end, wherein the upper end is coupled to the first output connection;

a first ballasting capacitor coupled between a first node and the lower end of the secondary winding of the output transformer;

a second ballasting capacitor coupled between a second node and the lower end of the secondary winding of the output transformer; and a current-sensing transformer, comprising:

a first winding coupled between the second output connection and the first node, wherein the operating current of the first gas discharge lamp flows through the first winding;

a second winding magnetically coupled to the first winding and electrically coupled between the third output connection and the second node, wherein the operating current of the second gas discharge lamp flows through the second winding; and a detection winding magnetically coupled to the first and second windings and electrically coupled to the protection circuit, and operable to provide a predetermined voltage in response to the predetermined imbalance in the operating currents of the first and second gas discharge lamps.

2. The ballast of claim 1, wherein the protection circuit comprises:

first and second input terminals coupled to the detection winding of the current-sensing transformer;

an output terminal coupled to a base of the second inverter transistor;

a first resistor coupled between the first and second input terminals;

a diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a fourth resistor coupled between the second input terminal and circuit ground; and a series combination of a second diode and an auxiliary winding, the series combination being coupled between the second input terminal and circuit ground, wherein the auxiliary winding is magnetically coupled to the primary and secondary windings of the output transformer.

3. The ballast of claim 2, wherein the electronic switch comprises a silicon-controlled rectifier having an anode coupled to the output terminal, a cathode coupled to the second input terminal, and a gate lead that is the control lead coupled to the sixth node.

4. The ballast of claim 1, wherein:

the lamp load further comprises third and fourth gas discharge lamps;

the output circuit further comprises:

fourth and fifth output connections, wherein:

the fourth output connection is coupled to the third gas discharge lamp;

the fifth output connection is coupled to the fourth gas discharge lamp;

a third ballasting capacitor coupled between a third node and the lower end of the secondary winding of the output transformer; and a fourth ballasting capacitor coupled between a fourth node and the lower end of the secondary winding of the output transformer; and the current-sensing transformer further comprising:

a third winding magnetically coupled to the first and second windings and the detection winding and electrically coupled between the fourth output connection and the third node, wherein the operating current of the third gas discharge lamp flows through the third winding;

a fourth winding magnetically coupled to the first, second, and third windings and the detection winding and electrically coupled between the fifth output connection and the fourth node, wherein the operating current of the fourth gas discharge lamp flows through the fourth winding; and wherein the detection winding is operable to provide a predetermined voltage in response to an imbalance in the operating currents of: (i) the first and second gas discharge lamps; and (ii) the third and fourth gas discharge lamps.

5. The ballast of claim 4, wherein the protection circuit comprises:

first and second input terminals coupled to the detection winding of the current-sensing transformer;

an output terminal coupled to a base of the second inverter transistor;

a first resistor coupled between the first and second input terminals;

a diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a fourth resistor coupled between the second input terminal and circuit ground; and a series combination of a second diode and an auxiliary winding, the series combination being coupled between the second input terminal and circuit ground, wherein the auxiliary winding is magnetically coupled to the primary and secondary windings of the output transformer.

6. The ballast of claim 5, wherein the electronic switch comprises a silicon-controlled rectifier having an anode coupled to the output terminal, a cathode coupled to the second input terminal, and a gate lead that is the control lead coupled to the sixth node.

7. The ballast of claim 1, wherein:

the ballast further comprises:

an electromagnetic interference (EMI) filter having a pair of input terminals adapted to receive a conventional source of alternating current (AC) voltage; and a rectifier circuit coupled between the EMI filter and the inverter; and the protection circuit comprises:

first and second input terminals coupled to the detection winding of the current-sensing transformer;

a third input terminal coupled to a junction of the EMI filter and the rectifier circuit;

an output terminal coupled to a base of the second inverter transistor;

a first resistor coupled between the first and second input terminals;

a first diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a second diode coupled between the second input terminal and a seventh node;

a zener diode coupled between the seventh node and circuit ground; and a third capacitor coupled between the seventh node and the third input terminal.

8. The ballast of claim 7, wherein the electronic switch comprises a silicon-controlled rectifier having an anode coupled to the output terminal, a cathode coupled to the second input terminal, and a gate lead that is the control lead coupled to the sixth node.

9. The ballast of claim 7, wherein:

the lamp load further comprises third and fourth gas discharge lamps;

the output circuit further comprises:

fourth and fifth output connections, wherein:

the fourth output connection is coupled to the third gas discharge lamp;

the fifth output connection is coupled to the fourth gas discharge lamp;

a third ballasting capacitor coupled between a third node and the lower end of the secondary winding of the output transformer; and a fourth ballasting capacitor coupled between a fourth node and the lower end of the secondary winding of the output transformer; and the current-sensing transformer further comprising:

a third winding magnetically coupled to the first and second windings and the detection winding and electrically coupled between the fourth output connection and the third node, wherein the operating current of the third gas discharge lamp flows through the third winding;

a fourth winding magnetically coupled to the first, second, and third windings and the detection winding and electrically coupled between the fifth output connection and the fourth node, wherein the operating current of the fourth gas discharge lamp flows through the fourth winding; and wherein the detection winding is operable to provide a predetermined voltage in response to an imbalance in the operating currents of: (i) the first and second gas discharge lamps; and (ii) the third and fourth gas discharge lamps.

10. The ballast of claim 9, wherein the protection circuit comprises:

first and second input terminals coupled to the detection winding of the current-sensing transformer;

a third input terminal coupled to a junction of the EMI filter and the rectifier circuit;

an output terminal coupled to a base of the second inverter transistor;

a first resistor coupled between the first and second input terminals;

a first diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a second diode coupled between the second input terminal and a seventh node;

a zener diode coupled between the seventh node and circuit ground; and a third capacitor coupled between the seventh node and the third input terminal.

11. The ballast of claim 10, wherein the electronic switch comprises a silicon-controlled rectifier having an anode coupled to the output terminal, a cathode coupled to the second input terminal, and a gate lead that is the control lead coupled to the sixth node.

12. A ballast powering a lamp load comprising at least a first and a second gas discharge lamp, the ballast comprising:

an inverter, comprising:

first and second input terminals;

first and second output terminals;

a first inverter transistor operably coupled between the first input terminal and the first output terminal; and a second inverter transistor operably coupled between the first output terminal and the second input terminal;

an output circuit, comprising:

first, second, and third output connections, wherein:

the first output connection is coupled to the first and second gas discharge lamps;

the second output connection is coupled to the first gas discharge lamp; and the third output connection is coupled to the second gas discharge lamp;

a resonant capacitor coupled between the first and second output terminals of the inverter;

an output transformer comprising a primary winding and a secondary winding, wherein:

the primary winding is coupled between the first and second output terminals of the inverter;

the secondary winding has an upper end and a lower end, wherein the upper end is coupled to the first output connection;

a first ballasting capacitor coupled between a first node and the lower end of the secondary winding of the output transformer;

a second ballasting capacitor coupled between a second node and the lower end of the secondary winding of the output transformer;

a current-sensing transformer, comprising:

a first winding coupled between the second output connection and the first node;

a second winding coupled between the third output connection and the second node; and a detection winding magnetically coupled to the first and second windings and electrically coupled to the protection circuit; and a protection circuit, comprising:

first and second input terminals coupled to the detection winding of the current-sensing transformer;

an output terminal coupled to a base of the second inverter transistor;

a first resistor coupled between the first and second input terminals;

a diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a fourth resistor coupled between the second input terminal and circuit ground; and a series combination of a second diode and an auxiliary winding, the series combination being coupled between the second input terminal and circuit ground, wherein the auxiliary winding is magnetically coupled to the primary and secondary windings of the output transformer.

13. The ballast of claim 12, wherein the electronic switch comprises a silicon-controlled rectifier having an anode coupled to the output terminal, a cathode coupled to the second input terminal, and a gate lead that is the control lead coupled to the sixth node.

14. The ballast of claim 13, wherein:

the lamp load further comprises third and fourth gas discharge lamps;

the output circuit further comprises:

fourth and fifth output connections, wherein:

the fourth output connection is coupled to the third gas discharge lamp;

the fifth output connection is coupled to the fourth gas discharge lamp;

a third ballasting capacitor coupled between a third node and the lower end of the secondary winding of the output transformer; and a fourth ballasting capacitor coupled between a fourth node and the lower end of the secondary winding of the output transformer; and the current-sensing transformer further comprising:

a third winding magnetically coupled to the first and second windings and the detection winding and electrically coupled between the fourth output connection and the third node; and a fourth winding magnetically coupled to the first, second, and third windings and the detection winding and electrically coupled between the fifth output connection and the fourth node.

15. A ballast powering a lamp load comprising at least a first and a second gas discharge lamp, the ballast comprising:

an inverter, comprising:

first and second input terminals;

first and second output terminals;

a first inverter transistor operably coupled between the first input terminal and the first output terminal; and a second inverter transistor operably coupled between the first output terminal and the second input terminal;

an output circuit, comprising:

first, second, and third output connections, wherein:

the first output connection is coupled to the first and second gas discharge lamps;

the second output connection is coupled to the first gas discharge lamp; and the third output connection is coupled to the second gas discharge lamp;

a resonant capacitor coupled between the first and second output terminals of the inverter;

an output transformer comprising a primary winding and a secondary winding, wherein:

the primary winding is coupled between the first and second output terminals of the inverter;

the secondary winding has an upper end and a lower end, wherein the upper end is coupled to the first output connection;

a first ballasting capacitor coupled between a first node and the lower end of the secondary winding of the output transformer;

a second ballasting capacitor coupled between a second node and the lower end of the secondary winding of the output transformer;

a current-sensing transformer, comprising:

a first winding coupled between the second output connection and the first node;

a second winding coupled between the third output connection and the second node; and a detection winding magnetically coupled to the first and second windings and electrically coupled to the protection circuit; and a protection circuit, comprising:

first and second input terminals coupled to the detection winding of the current-sensing transformer;

a third input terminal coupled to a junction of the EMI filter and the rectifier circuit;

an output terminal coupled to a base of the second inverter transistor;

a first resistor coupled between the first and second input terminals;

a first diode coupled between the first input terminal and a fifth node;

a first capacitor coupled between the fifth node and the second input terminal;

a second resistor coupled between the fifth node and a sixth node;

a third resistor coupled between the sicth node and the second input terminal;

an electronic switch coupled between the output terminal and the second input terminal; the electronic switch having a control lead coupled to the sixth node;

a second capacitor coupled between the second input terminal and circuit ground;

a second diode coupled between the second input terminal and a seventh node;

a zener diode coupled between the seventh node and circuit ground; and a third capacitor coupled between the seventh node and the third input terminal.

16. The ballast of claim 15, wherein the electronic switch comprises a silicon-controlled rectifier having an anode coupled to the output terminal, a cathode coupled to the second input terminal, and a gate lead that is the control lead coupled to the sixth node.

17. The ballast of claim 16, wherein:

the lamp load further comprises third and fourth gas discharge lamps;

the output circuit further comprises:

fourth and fifth output connections, wherein:

the fourth output connection is coupled to the third gas discharge lamp;

the fifth output connection is coupled to the fourth gas discharge lamp;

a third ballasting capacitor coupled between a third node and the lower end of the secondary winding of the output transformer; and a fourth ballasting capacitor coupled between a fourth node and the lower end of the secondary winding of the output transformer;

the current-sensing transformer further comprising:

a third winding magnetically coupled to the first and second windings and the detection winding and electrically coupled between the fourth output connection and the third node; and a fourth winding magnetically coupled to the first, second, and third windings and the detection winding and electrically coupled between the fifth output connection and the fourth node.

* * * * *